United States Patent [19]

Junghans et al.

[11] 4,072,106

[45] Feb. 7, 1978

[54] WASHING DEVICE FOR CLEANING THE BLANKET CYLINDER OF AN OFFSET PRINTING PRESS

[75] Inventors: Rudi Junghans, Wilhelmsfeld; Hermann Beisel, Walldorf, both of Germany

[73] Assignee: Heidelberger Druckmaschinen AG, Heidelberg, Germany

[21] Appl. No.: 631,677

[22] Filed: Nov. 13, 1975

[30] Foreign Application Priority Data

May 10, 1975 Germany ..... 2520919

[51] Int. Cl.[2] ..... B41F 35/06

[52] U.S. Cl. ..... 101/425; 101/350

[58] Field of Search ..... 101/425, DIG. 14, 349, 101/350, 364, 366, 367

[56] References Cited

U.S. PATENT DOCUMENTS

| | | | |
|---|---|---|---|
| 511,934 | 1/1894 | Cottriell | 101/425 |
| 1,072,244 | 9/1913 | Lynch | 101/425 |
| 1,574,570 | 2/1926 | Goulding | 101/425 |
| 1,946,217 | 2/1934 | Kranz | 101/DIG. 14 |
| 2,199,469 | 5/1940 | Seel et al. | 101/425 |
| 2,786,413 | 3/1957 | Richter | 101/425 |
| 2,970,541 | 2/1961 | Gegenheimer | 101/425 |
| 3,106,154 | 10/1963 | Saul | 101/350 |
| 3,309,993 | 3/1967 | Gremebecki et al. | 101/425 |
| 3,422,758 | 1/1969 | Brewster | 101/425 |
| 3,467,008 | 9/1969 | Domotor | 101/425 X |
| 3,673,959 | 8/1972 | Jezuit | 101/425 X |
| 3,701,316 | 10/1972 | Sylvester et al. | 101/425 X |
| 3,763,778 | 10/1973 | Sills et al. | 101/425 X |
| 3,771,450 | 11/1973 | Cleybergh | 101/425 |
| 3,845,713 | 11/1974 | Ross et al. | 101/425 X |
| 3,850,099 | 11/1974 | Laben | 101/425 |

*Primary Examiner*—Jay N. Eskovitz
*Assistant Examiner*—Paul J. Hirsch
*Attorney, Agent, or Firm*—Herbert L. Lerner

[57] ABSTRACT

A washing device for an offset printing press has a blanket cylinder, the washing device being adjustable with respect to the blanket cylinder and including a rotary washing roller having a soft covering and being in frictional driving engagement with the blanket cylinder, a doctor roller having a surface located in engagement with the washing roller, a distributor roller having a firm surface engaging the soft covering of the washing roller at a location upstream of the doctor roller in the rotary direction of the washing roller, means for feeding and controllably applying fresh washing solution to the distributor roller, a collecting vessel located below the doctor roller, and a doctor blade operatively connected with the doctor roller for guiding therefrom into the collecting vessel ink washed off the blanket cylinder with the wash solution, the improvement therein and further comprises a second washing roller in frictional driving engagement with the blanket cylinder, both of the washing rollers being traversible relative to the blanket cylinder and being additionally drivable by the doctor roller, both the washing rollers being disconnectible respectively from at least one of the blanket cylinder and the doctor roller.

7 Claims, 4 Drawing Figures

WASHING DEVICE FOR CLEANING THE BLANKET CYLINDER OF AN OFFSET PRINTING PRESS

This invention relates to a washing device for cleaning the blanket cylinder or an offset printing machine, the device comprising a washing roller having a soft covering, the washing roller being driven by friction against the blanket cylinder and being capable of being brought into and out of contact with the latter when required, a distributor roller having a firm surface and disposed upstream of the washing roller, the distributor roller serving to regulate the washing solution to be applied to the blanket cylinder, means for feeding and controllably applying fresh washing solution to the distributor roller, and a doctor roller engaging the washing roller and, cooperatively connected with a doctor blade, conducting the washed-off dirt to a collecting vessel.

It is an object of the invention to provide a washing device for cleaning the blanket cylinder of an offset printing unit as effectively as possible, in the shortest time and with the most economical consumption of washing solution, and thereupon re-drying the blanket cylinder.

From German Published Prosecuted Application No. 2,122,515, a cleaning device for a duplicating machine has become known, wherein two rollers are applied against the surface of the blanket drum which is to be cleaned, these rollers being called cleaning rollers and cooperating with a metering roller which is disposed in the gap formed between them and which is charged with fresh cleaning liquid.

This device has the disadvantage that the two rollers participating in the cleaning operation have to serve a dual purpose. The first of the two cleaning rollers serves in fact to transfer the fresh cleaning liquid to the rubber blanket and at the same time to carry away the dirt that is on the latter, while the second roller, disposed downstram of the first, similarly has to serve as a washing solution feed roller and also has to fulfill the functions of a cleaning roller and a doctor roller. Since only the second roller engaging the rubber blanket of the blanket cylinder cooperates with a stripper, the dirt removed by the first cleaning roller from the blanket cylinder is transferred to the metering roller, on which it is mixed with the fresh cleaning liquid, particularly through the friction in the gap between the metering roller and the second cleaning roller. The cleaning action of this heretofore known device is thereby greatly reduced and the completion of the washing operation thus considerably delayed.

In the washing device of German Pat. No. 2,158,185, which is adjustable with respect to the blanket cylinder of an offset machine, the disadvantages of the hereinbefore mentioned device are overcome by providing three rollers, namely a distributor roller, a washing roller, and a doctor roller at the blanket cylinder, due to the fact that each of these rollers have only a separate function allocated to them.

In this just-mentioned washing device, however, the fact that only one washing roller is applied against the blanket cylinder and is driven exclusively by the latter has a disadvantageous effect. It has in fact been found in practice that when fresh washing solution is applied on or over the washing roller, the fresh washing solution and the residues of ink may accumulate in the gap between the washing roller and the blanket cylinder and thus give rise to so-called aquaplaning between the soft covering of the washing roller and the rubber blanket. The consequence thereof is that the washing roller remains partly stationary or rotates backwards. Since the dirt or ink residues are removed from the blanket cylinder in accordance with the principle of the separation of wet liquid films, there is no doubt that by providing a single washing roller it is not possible to achieve optimum cleaning action in a short period of time. Furthermore, the drying process is delayed with this heretofore known device because both the distributor roller as well as the washing roller always run in wet condition and, after stopping the feeding of washing solution, they must then first run in dry condition.

It is accordingly an object of the invention to provide a washing device which has an efficiency that is so high that its cleaning action is thereby substantially improved, and the time required for the washing operation and subsequent drying is considerably shortened, while the washing roller is not held stationary during the washing process.

With the foregoing and other objects in view, there is provided in accordance with the invention, a washing device for an offset printing press having a blanket cylinder, the washing device being adjustable with respect to the blanket cylinder and including a rotary washing roller having a soft covering and being in frictional driving engagement with the blanket cylinder, a doctor roller having a surface located in engagement with the washing roller, a distributor roller having a firm surface engaging the soft covering of the washing roller, at a location upstream of the doctor roller in the rotary direction of the washing roller, means for feeding and controllably applying fresh washing solution to the distributor roller, a collecting vessel located below the doctor roller, and a doctor blade operatively connected with the doctor roller for guiding therefrom into the collecting vessel ink washed off the blanket cylinder with the wash solution, and further comprising a second washing roller in frictional driving engagement with the blanket cylinder, both of the washing rollers being traversible relative to the blanket cylinder and being additionally drivable by the doctor roller, both the washing rollers being disconnectible respectively from at least one of the blanket cylinder and the doctor roller.

This construction produces effective cleaning of the blanket cylinder within the shortest period of time and with the most economical consumption of washing solution. Through the additional traversibility of the two washing rollers, the ink and dirt on the blanket cylinder are more quickly loosened and therefore more readily removed from the blanket cylinder. Furthermore, even when passing over the blanket cylinder gap and when liquid accumulates in the gap between the washing roller and the blanket cylinder, the washing device nevertheless runs continuously. Since only the first washing roller is charged with washing solution and the second washing roller exclusively carries off dirty solution, the phase of running dry which immediately follows the washing operation is additionally kept as short as possible.

In order to achieve particularly good cleaning action and also an intensive drying action with the washing device and to enable the latter to be rapidly brought into and out of action, in accordance with a further feature of the invention, the second washing roller is disposed downstream from the first washing roller, with respect to the direction of rotation of the blanket cylinder, and the two washing rollers together with the distributor roller and the doctor blade form a group constituting a conjointly displaceable unit.

One advantageous embodiment of the invention is characterized in that the washing rollers and the distributor roller are radially sprung and floatingly mounted in guides. The pressure by which the washing rollers are applied both against the doctor roller and against the blanket cylinder can thereby be kept constant even when different thicknesses of paper are printed and the blanket cylinder is adjusted accordingly, while, in addition, irregularities in the surface of the rubber blanket of the blanket cylinder are thereby compensated.

In accordance with an additional feature of the invention which is advantageous with respect to the ease of operation of the washing device, the conjointly displaceable unit is brought into and out of action by means of an operating lever and a common actuating shaft, on which both a first control hub for controlling the doctor and a second control hub for displacing the washing rollers in conjunction with the distributor roller are fastened.

Although the invention is illustrated and described herein as embodied in washing device for cleaning the blanket cylinder of an offset printing press, it is nevertheless not intended to be limited to the details shown, since various modifications and structural changes may be made therein without departing from the spirit of the invention and within the scope and range of equivalents of the claims.

The construction and method of the invention, however, together with additional objects and advantages thereof will be best understood from the following description of specific embodiments when read in connection with the accompanying drawings, in which.

Figure 1:
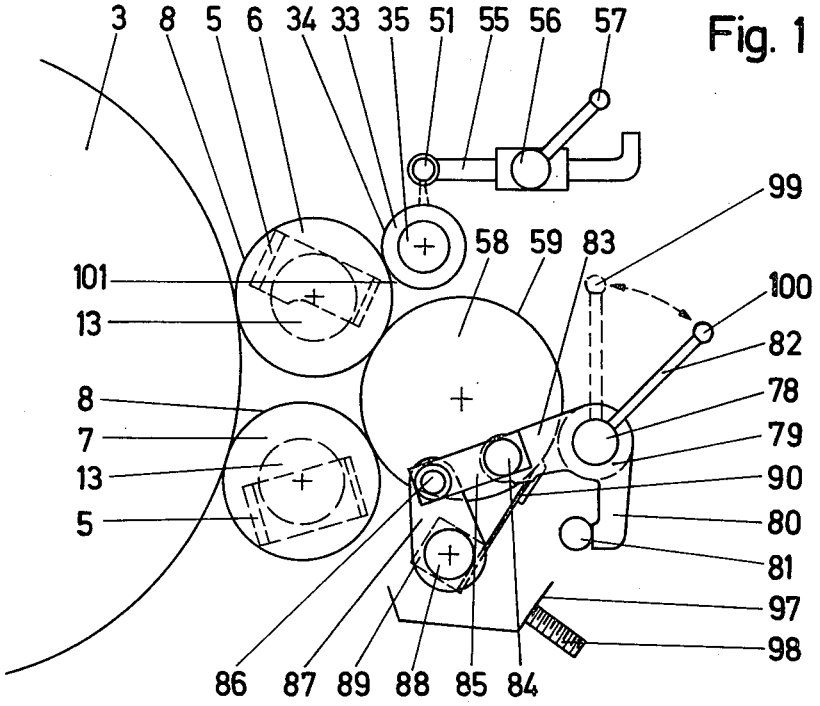
FIG. 1 is a front view of a washing device in operative position, as viewed from the servicing side of the printing press.

Referring now to the drawing, guides 5 are shown fastened on both sides by screws 4 to the inner sides of side walls 1 and 2 of the machine, in front of a blanket cylinder 3. A first washing roller 6 and, downstream therefrom in the direction of rotation of the blanket cylinder 3, a second washing roller 7 are mounted floatingly in the guides 5 and in such a manner as to be traversible.

The washing rollers 6 and 7 are provided with a soft covering 8, which, however, absorbs no moisture. Wide cam discs 11 which have inclined end faces 12 are fastened to the shafts 9 and 10 of the washing rollers 6 and 7, and ball bearings 13 are provided on the ends of these shafts 9 and 10.

The inclined end faces 12 of the wide cam discs 11 run against cam rollers 14 and thereby effect the traversing motion of the washing rollers 6 and 7. The cam rollers are rotatably mounted in holders 15, which are fastened on both sides to the inner sides of the side walls 1 and 2 by means of screws 16. In the peripheral or jacket surface of the wide cam disc 11, O-rings 17 are inserted, which, in the operative position of the washing device, are in contact with respective opposing bearer or Schmitz rings 18 of the blanket cylinder 3 and thereby drive the washing rollers 6 and 7 by frictional contact.

In the region of the ball bearings 13 of the first washing roller 6, spring levers 19, which are rockable about pins 20, are disposed on both sides at the inner sides of the side walls 1 and 2. Each of the spring levers 19 is provided with an inclined surface 21 at the end thereof and with a spring pin 22, at the middle thereof, the spring pin 22 being biased by a compression spring 23, the latter being supported against a surface of a blind bore 24 formed in the spring lever 19 and pressing the spring pin 22 against the respective ball bearing 13 of the first washing roller 6.

Furthermore, on each side of the inner sides of the side walls 1 and 2, in the vicinity of the floating ball bearings 13 of the second washing roller 7, shoulder levers 25 provided with respective supporting shoulders 26 are articulated about a bearing pin 27. Each of the shoulder levers 25 is provided at its upper end with a supporting screw 28 against which there presses a spring bearing 29 which is disposed on the end of an adjusting screw 30. The pressure of the spring bearing 29 against the supporting screw 28 and the resulting force by which the supporting shoulder 26 is pressed against the floating ball bearing 13 of the second washing roller 7 are effected with the aid of a compression spring 31, which is disposed between the spring bearing 29 and an additional spring abutment or counterbearing 32 provided on the adjusting screw 30. The compression spring 31 is braced against the spring abutment 32, which is anchored to the inner side of the respective side wall 1 or 2.

Upstream of the first washing roller 6, viewed in the direction of rotation thereof, a distributor roller 33 is disposed which is provided with a firm covering 34. The firm covering 34 is preferably formed of a hard synthetic material. The ball bearings 35 of the distributor roller 33 are likewise mounted floatingly in guides 36 fastened on both sides to the inner side of the side walls 1 and 2. In the vicinity of these floating ball bearings 35, rocking levers 37 capable of rocking about pivot pins 38 are mounted on both sides at the inner sides of the side walls 1 and 2.

Each of the rocking levers 37 is provided at an end thereof with a supporting surface 21 of the respective spring lever 19. At the other end of each rocking lever 37, an eyebolt 41 is articulatingly connected by means of a pin 40; the threaded portion 42 of the eyebolt 41 extends in vertical position through a guide block 43 and can be clamped to the latter by means of a crosswing nut 44. The guide block 43 is provided with a lateral recess extending to the middle thereof and firmly anchored by means of a pin 45 in the respective side wall 1 or 2. In addition, each rocking lever 37 is provided in the vicinity of its supporting surface 39 with a spring pin 46 biased by a compression spring 47 which is braced against the surface of a blind bore 48 provided in the rocking lever 37 and thereby presses the distributor roller 33 against the first washing roller 6.

Above the distributor roller 33, a drip-feed tube 51 is bolted to the machine frame with the aid of holders 49 and threaded bolts 50, the tube 51 being provided with nozzle apertures 52. A drain plug 53 is provided at one end of the drip-feed tube 51, while the other end is connected through an elbow 54 to a supply pipe 55 for the washing liquid. The supply pipe 55 contains a valve 56 which can be opened and closed as desired by means of a control lever 57.

A doctor roller 58, which is provided with a firm covering 59, is disposed upstream of the washing rollers 6 and 7 and is laterally offset in relation to the latter, on the side opposite to the blanket cylinder 3. The firm covering in question may be either a metallic material or a plastics material of high consistency. The doctor roller 58 is mounted for traversing by means of slide bearings 60 and 61 in the side walls 1 and 2 of the machine frame.

In the outer side of the side wall 2, a recess 62 is provided wherein a gear 64 is mounted in ball bearings 63. The ball bearings 63 on the outer side of the gear 64 are embedded in a centering ring 65 which is bolted to the outer side of the side wall 2 by means of a clamp bolt 66. The gear 64 is formed with a bore 67 and with two diametrically opposed guide grooves 68 through which the shaft 69 of the doctor roller 58 extends.

In the center of the gear 64, the shaft 69 is formed with two diametrically opposed recesses 70 through which a through-bolt 71 extends, pinned to the shaft 69. On the ends of the through-bolt 71, two guide rollers 72 are mounted in needle bearings, the guide rollers 72 being partly embedded in the recesses 70 and, in the operating condition, cooperating with the guide grooves 68 of the gear 64. A guide sleeve 73, which is provided with two guide rings 74, is fastened in front of the gear 64 on the end of the shaft 69 of the doctor roller 58. A lever 76, which is driven in a non-illustrated manner and, by rocking about a pivot point 77, effects the traversing of the doctor roller 58, is articulatingly connected within the guide rings 74 by means of a hub 75.

A first control hub 79 is fastened, outside the side wall 2 on the operating or servicing side of the machine, to an actuating shaft 78 disposed in front of the doctor roller 58. The control hub 79 has a stop 80 which cooperates with a stop pin 81 fastened in the side wall 1. In addition, the control hub 79 is equipped with an operating lever 82 and with a swiveling shoulder 83, on which a short control lever 85 is articulatingly connected by means of a pin 84. The other end of the short control lever 85 is articulatingly connected by another pin 86 to a control lever 87 in which the bearing pin 88 of a square 89 is fastened. A doctor 90 is secured to one side of the square 89.

On the same actuating shaft 78, but laterally offset in relation to the first control hub 79, there is fastened inside the side wall 1 of the machine frame, a second control hub 91, on which, by means of a pin 92, a long control rod 93 is articulatingly connected, a cam disc 94 being movably mounted on another pin 95 at the other end of the control rod 93, the cams 96 of the cam disc 94 being in contact with the floating bearings 13 of the washing rollers 6 and 7.

Below the doctor roller 58 is a collecting vessel 97 disposed in a stationary position within the range of operation of the doctor blade 90, the collecting vessel 97 being provided with an outlet pipe 98.

The mode of operation of the hereinbefore described and illustrated apparatus of the invention, is described more fully hereinbelow with reference to the drawings.

Figure 2:
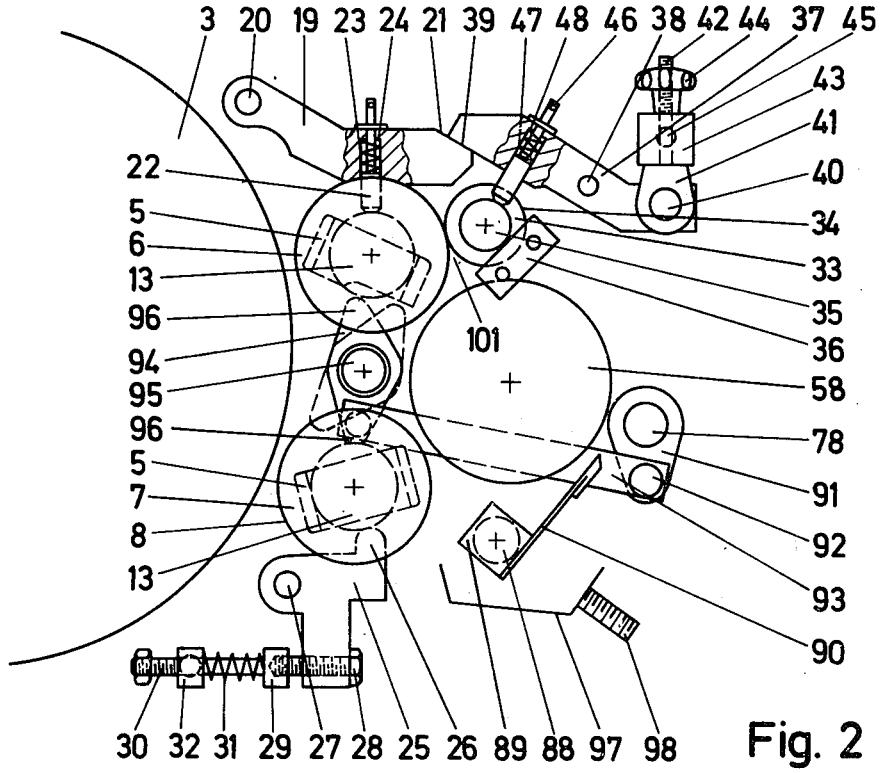
FIG. 2 is a side view of FIG. 1 in inoperative position thereof and showing the axial spring system for the individual rollers.
Figure 3:
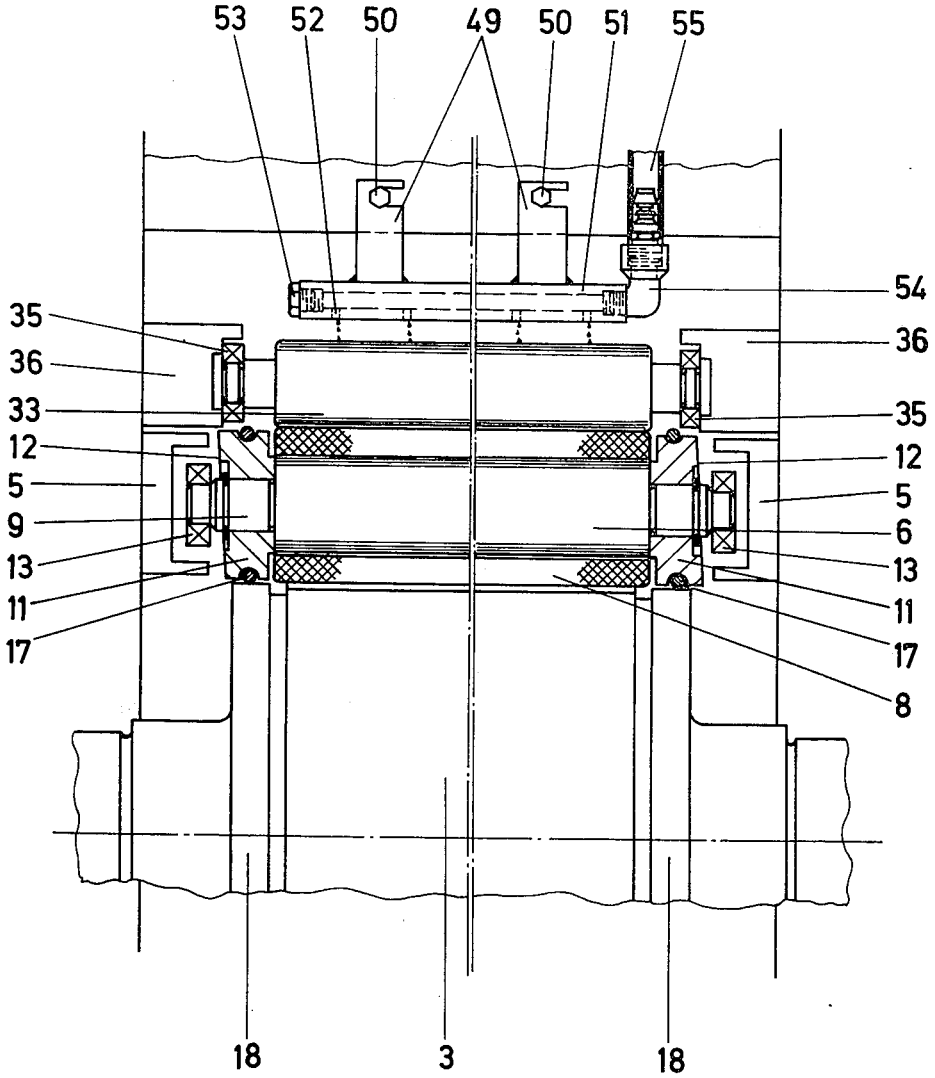
FIG. 3 is a plan view, partly in section, of FIG. 1, rotated through 90° and showing the disposition of the washing medium supply system.
Figure 4:
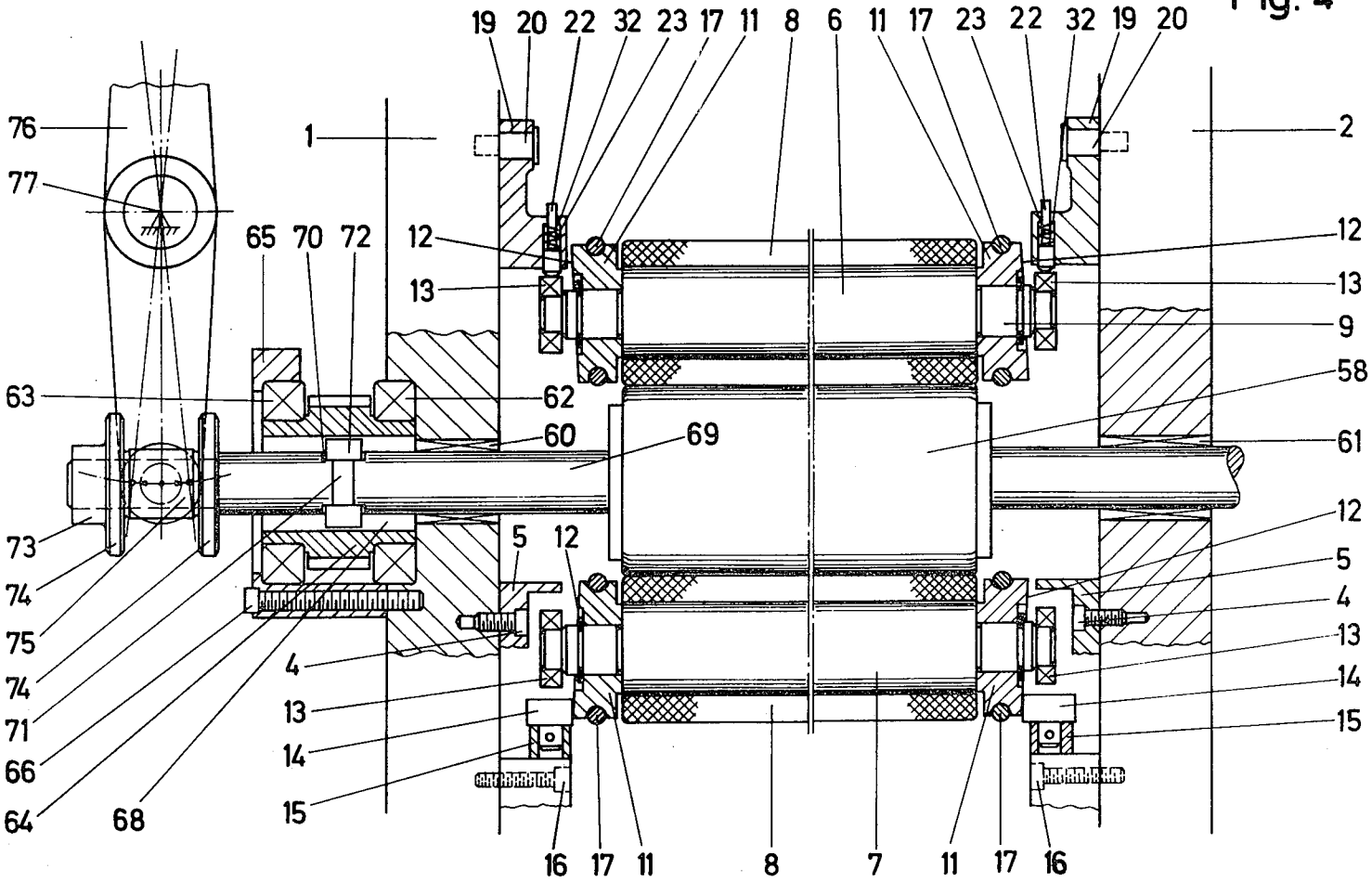
FIG. 4 is a plan view, partly in section, of FIG. 2, rotated through 90° and showing the bearing system for the washing rollers and the lateral drive of the doctor roller.

As illustrated in FIG. 2, the floating ball bearings 13 of the washing rollers 6 and 7 are held by the two cams 96 of the cam disc 94 in the upper region of the guides 5 when the washing device is in inoperative position. The washing rollers 6 and 7 are then in a disconnected position, e.g. they are disconnected both from the blanket cylinder 3 as well as from the doctor roller 58. When the washing device is in inoperative position, the first washing roller 6 is secured against falling downwardly out of the guides 5 by the upper of the two cams 96 of the cam disc 94, while the second and lower washing roller 7 is similarly secured by the supporting shoulder 26 of the shoulder levers 25. The distributor roller 33 is held by the first washing roller 6, against which it continuously bears. The doctor blade 90 is also disconnected from the doctor roller 58 when the washing device is in inoperative position.

In order to clean the blanket cylinder 3 to remove dirt and ink residues, the operating lever 82 fastened to the first control hub 79 is swiveled from the vertical position 99 thereof, in which the washing device is secured in inoperative position, into an inclined control position 10 thereof, wherein the stop 80 strikes against the stop pin 81, and which constitutes the operative position. By means of the short control lever 85 articulatingly connected to the swiveling shoulder 83, the square 89 fastened in the control lever 87 is thereby turned in such a manner that the doctor blade 90 mounted thereon, bears against the firm coating 59 of the doctor roller 58. The compressive force with which the doctor blade 90 is pressed against the doctor roller 58 can be adjusted in a non-illustrated manner.

Through the swiveling movement of the operating lever 82, the second control hub 91 fastened to the actuating shaft 78 is simultaneously turned, whereby the long control rod 93 articulating with the second control hub 91 is shifted in direction toward the blanket cylinder 3.

The cam disc 94 mounted in the end of the long control rod 93 is turned by the lever action in such a manner that the two cams 96 thereof, pass out of the range of action of the floating bearings 13 of the two washing rollers 6 and 7. Consequently, the first washing roller 6 can slide downwards into the guides 5 and bear against the blanket cylinder 3 and the doctor roller 58. The second washing roller 7, on the other hand, is pressed against the blanket cylinder 3 and the doctor roller 58 by the compressive force applied by the supporting shoulders 26 of the shoulder levers 25 to the floating bearings 12.

The distributor roller 33 participates simultaneously in this adjustment and, due to the spring force of the spring pin 46 disposed in the rocking lever 37, is continuously in pressure contact with the first washing roller 6.

As the rollers and doctor are simultaneously brought into contact by means of the operating lever 82, the valve 56 disposed in the supply pipe 55 is opened by means of the control lever 57, and the supply of washing solution to the drip-feed tube 51 is thereby freed.

The fresh washing solution can then drip onto the firm coating 34 of the distributor roller 33, where it is spread out in the nip 101 between the first washing roller 6 and the distributor roller 33 and uniformly distributed over the soft covering 8 of the first washing roller 6. The first washing roller 6 transfers the fresh washing solution to the blanket cylinder 3 and simultaneously removes part of the dirt from the latter, transferring that part of the dirt to the doctor roller 58 downstream therefrom.

It has been found advantageous for the quantity of washing solution to be applied to the blanket cylinder 3 to be metered slowly so that it does not wash off the dirt from the cylinder 3 but only loosens it slightly. This loosening is effected previously in the vicinity of the blanket cylinder 3 between the first washing roller 6 and the second washing roller 7, so that the remainder of the dirt which has thus been loosened but not yet carried away by the first washing roller 6 is entrained by the second washing roller 7 and likewise transferred to the doctor roller 58 located downstream therefrom. The firm coating 59 of the doctor roller 58 is continuously wiped by the doctor blade 90 which is applied against it and is freed of residues of ink as well as of soiled washing solution, which are passed to the collecting vessel 97, so that a surface of the doctor roller 58 that has been wiped clean, always engages the washing rollers 6 and 7.

Because, as mentioned hereinbefore, only a small quantity of washing solution is required, it is also fully adequate for the valve 56 to be opened by means of the control lever 57, only for a brief period, that is to say for only a few seconds. In practice, this means that when the blanket cylinders 3 of the plurality of printing units have to be cleaned in succession in a multicolor printing machine, the washing rollers and doctor are first brought into contact and then the feeding of washing solution is initiated for each of the successive printing units. Experience has shown that this can be done within a few seconds. The hereinbefore described apparatus thus exhibits so thorough and rapid a cleaning action that immediately after the washing rollers and doctor have been brought into operation in the last printing unit, the supply of washing solution for the individual printing units can be shut off at once, starting from the first printing unit.

The supply of washing solution is shut off by closing the valve 56 by means of the control lever 57 and the washing rollers 6 and 7 are brought out of contact with the blanket cylinder 3 and with the doctor roller 58 and the doctor blade 90 is brought out of contact with the firm covering 59 of the doctor rollers 58 by turning the operating lever 82 from the inclined control position 100 thereof into the vertical position 99 thereof. The long control rod 93 is thus moved away from the blanket cylinder 3, whereby the two cams 96 of the cam disc 94 are pressed against the floating bearings 13 of the washing rollers 6 and 7, which are thus at the same time lifted off the blanket cylinder 3 and the doctor roller 58, together with the distributor roller 33.

In order to gain access to the first washing roller 6 and to the distributor roller 33, or in order to be able to dismantle them, the clamping of the eyebolts 41 to the guide blocks 43 is released by loosening the cross-wing nuts 44 on the threaded portion 42 of the eyebolts 41. The eyebolts 41 are then swung laterally away and out of the recessed guide blocks 43, and the rocking levers 37 are swung about the pivot pins 38 until their supporting surface 39 lifts off the inclined surface 21 of the spring levers 19 and the supporting surface 39 per se assumes a vertical position. The spring levers 19 can then also be swung upwardly about the pins 20, away from the first washing roller 6. Both the first washing roller 6 as well as the distributor roller 33 then lie completely free and are readily accessible.

Since the loosened ink is removed from the blanket cylinder 3 in accordance with the principle of separation of wet liquid films, the provision of a second washing roller 7 in addition to the washing roller 6 is found paticularly advantageous because of the thorough cleaning action and the consequent saving of time in the washing process. The traversing of both the washing rollers is also advantageous from the point of view of effective cleaning, since in this way the ink and dirt on the blanket cylinder 3 are more effectively attacked, more quickly dissolved, and more easily removed.

Since the washing rollers 6 and 7 are driven not only by the bearer or Schmitz rings 18 of the blanket cylinder 3 through the O-rings 17, but also frictionally by bearing directly against the positively driven doctor roller 58, the rotation of the washing rollers 6 and 7 is not interrupted when they pass through the cylinder gap of the blanket cylinder 3, but is continued without interruption. The consequence thereof is that even after passing beyond the cylinder gap, on the one hand, fresh washing solution will always be applied by the clean first washing roller 6 to the blanket cylinder 3 while, on the other hand, the clean covering 8 of the second washing roller 7 will always be ready to absorb the dirt from the blanket cylinder 3, because even while passing over the cylinder gap, the washing roller 6 and 7 will have surrendered to the doctor roller 58 the dirt removed from the blanket cylinder 3 just forward of the cylinder gap.

There is claimed:

1. In a washing device for an offset printing press having a blanket cylinder, the washing device being adjustable with respect to the blanket cylinder and including a rotary washing roller having a soft covering and being in frictional driving engagement with the blanket cylinder, a doctor roller having a surface located in engagement with the washing roller, a distributor roller having a firm surface engaging the soft covering of the washing roller at a location upstream of the doctor roller in the rotary direction of the washing roller, means for feeding and controllably applying fresh washing solution to said distributor roller, a collecting vessel located below said doctor roller, and a doctor blade operatively connected with the doctor roller for guiding therefrom into the collecting vessel ink washed off the blanket cylinder with the wash solution, the improvement therein which comprises a second washing roller in frictional driving engagement with the blanket cylinder, means for effecting traversal of the blanket cylinder by both of said washing rollers, said washing rollers being additionally drivable by said doctor roller, both said washing rollers simultaneously being respectively connectible to and disconnectible from said blanket cylinder and said doctor roller.

2. Washing device according to claim 1 wherein said second washing roller is disposed downstream from the first-mentioned washing roller in respect to the direction of rotation of the blanket cylinder, both said washing rollers together with said distributor roller and said doctor blade forming a group constituting a conjointly displaceable unit.

3. Washing device according to claim 2 including means for moving both said washing rollers so that they are simultaneously connectible with the blanket cylinder as well as with said doctor roller, and means for adjusting said doctor blade with respect to said doctor roller simultaneously with the connection of said washing rollers with the blanket cylinder as well as with said doctor roller.

4. Washing device according to claim 3 wherein both said washing rollers and said distributor roller are radially sprung and floatingly mounted in guides.

5. In a washing device for an offset printing press having a blanket cylinder, the washing device being adjustable with respect to the blanket cylinder and including a rotary washing roller having a soft covering and being in frictional driving engagement with the blanket cylinder, a doctor roller having a surface located in engagement with the washing roller, a distributor roller having a firm surface engaging the soft covering of the washing roller at a location upstream of the doctor roller in the rotary direction of the washing roller, means for feeding and controllably applying fresh washing solution to said distributor roller, a collecting vessel located below said doctor roller, and a doctor blade operatively connected with the doctor roller for guiding therefrom into the collecting vessel ink washed off the blanket cylinder with the wash solution, the improvement therein which comprises a second washing roller in frictional driving engagement with the blanket cylinder, means for effecting traversal of the blanket cylinder by both of said washing rollers, said washing rollers being additionally drivable by said doctor roller, both said washing rollers being disconnectible respectively from at least one of said blanket cylinder and said doctor roller, said second washing roller being disposed downstream from the first-mentioned washing roller in respect to the direction of rotation of the blanket cylinder, both said washing rollers together with said distributor roller and said doctor blade forming a group constituting a conjointly displaceable unit, including means for moving both said washing rollers simultaneously into contact with the blanket cylinder as well as with said doctor roller, and means for adjusting said doctor blade with respect to said doctor roller simultaneously with movement of said washing rollers into contact with the blanket cylinder as well as with said doctor roller, further including radial spring means for said first-mentioned washing roller comprising two spring levers having spring pins and formed with inclined surfaces, radial spring means for said distributor roller comprising supporting surface means of two rocking levers having therein second spring pins for supporting the rocking levers on said spring levers, and radial spring means for said second washing roller comprising two spring-loaded shoulder levers having supporting shoulders, said spring levers being rotatably mounted on the inner side of a pair of side walls in operable cooperation with floating bearing means for said first-mentioned washing roller, said rocking levers being similarly mounted in operable cooperation with floating bearing means for said distributor roller, and said shoulder levers being similarly mounted in operable cooperation with floating bearing means for said second washing roller.

6. Washing device according to claim 5 including operating lever means and common actuating shaft means for bringing said conjointly displaceable unit into and out of engagement, a first control hub for controlling said doctor blade mounted on said common actuating shaft means, and a second control hub for displacing both said washing rollers together with said distributor roller also mounted on said common actuating shaft means.

7. Washing device according to claim 6 wherein said first control hub is secured to said common actuating shaft means outside said side walls and has a stop, an operating lever and a rocking shoulder, said stop cooperating with a stop pin fixed in one of said side walls and securing mutual engagement of said doctor blade and said doctor roller, a short control lever articulating with said rocking shoulder, said short control lever cooperating with another control lever for controlling movement of said doctor blade, said second control hub being secured on said common actuating shaft means inside said side walls and laterally offset with respect to said first control hub, a long control rod articulating with said second control hub and having a cam disc secured to an end thereof said cam disc having a plurality of cams operatively connected to said floating bearing means of said washing rollers, said operating lever being disposed on said first control hub, said common actuating shaft being revolvable by said operating lever.

* * * * *